United States Patent [19]

Küpfer et al.

[11] Patent Number: 4,608,059

[45] Date of Patent: Aug. 26, 1986

[54] METHOD OF OPERATING A REACTOR FOR GASIFYING SOLID FUELS

[75] Inventors: Hans Küpfer; Carl Hafke, both of Frankfurt am Main, Fed. Rep. of Germany

[73] Assignee: Metallgesellschaft Aktiengesellschaft, Frankfurt am Main, Fed. Rep. of Germany

[21] Appl. No.: 652,760

[22] Filed: Sep. 20, 1984

[30] Foreign Application Priority Data

Sep. 20, 1983 [DE] Fed. Rep. of Germany ..... 3333870

[51] Int. Cl.[4] ..... C10J 3/06; C10J 3/14; C10J 3/16

[52] U.S. Cl. ..... 48/197 R; 48/66; 48/206; 48/210; 48/DIG. 10

[58] Field of Search ..... 48/202, 206, 210, 66, 48/68, DIG. 10, 197 R

[56] References Cited

U.S. PATENT DOCUMENTS

| | | | |
|---|---|---|---|
| 2,808,321 | 10/1957 | Junkers | 48/68 |
| 4,030,895 | 6/1977 | Caughey | 48/101 |
| 4,453,949 | 6/1984 | Fasching et al. | 48/66 |

FOREIGN PATENT DOCUMENTS

| | | | |
|---|---|---|---|
| 0144172 | 10/1980 | Fed. Rep. of Germany | 48/210 |
| 0150756 | 9/1981 | Fed. Rep. of Germany | 48/210 |
| 0207552 | 3/1984 | Fed. Rep. of Germany | 48/210 |

*Primary Examiner*—Peter Kratz

*Attorney, Agent, or Firm*—Karl F. Ross; Herbert Dubno

[57] ABSTRACT

The fuel constitutes a fixed bed in the reactor, which is provided in its lower portion with a rotating grate, which is adapted to be speed-controlled. The gasifying agents consisting of oxygen, steam and/or carbon dioxide are introduced through the rotating grate into the fixed bed. Under the action of the rotating grate the incombustible mineral constituents are delivered as solid ash to a lock chamber container. The speed of the rotating grate is controlled in dependence on the temperature in the lock chamber container. The speed will be decreased when the temperature in the lock chamber container exceeds a desired value, and increased when the temperature is too low. The desired temperature in the lock chamber container is taken into account as a range, which varies with time. The speed can be controlled by hand or can be automatically controlled with the aid of a computer. The rate at which oxygen as a gasifying agent is supplied to the reactor is also taken into account in the speed control.

1 Claim, 2 Drawing Figures

METHOD OF OPERATING A REACTOR FOR GASIFYING SOLID FUELS

FIELD OF THE INVENTION

This invention relates to a method of operating a reactor for gasifying solid fuels and, more particularly, coal, lignite and peat with oxygen, steam and/or carbon dioxide.

BACKGROUND OF THE INVENTION

Solid fuel gasification under a pressure of 10 to 150 bars by a treatment with oxygen and with steam and/or carbon dioxide as gasifying agents, is known. In such processes the fuel in the reactor constitutes a fixed bed, which slowly subsides, the gasifying agents are introduced into said bed through a rotating grate, which rotates at a controlled speed, and the incombustible mineral constituents are withdrawn as ash by the action of the rotating grate and are delivered to a lock chamber container, which is periodically closed, pressure-relieved and emptied.

The gasification of granular coal in a fixed bed is known and has been described, e.g. in *Ullmanns Enzyklopadie der technischen Chemie,* 4th edition (1977), Volume 14, pages 383 to 386. Details of the design of the reactor and of the associated rotating grate are apparent from German Pat. Nos. 23 51 963; 23 46 833; 25 24 445; and open German application DE-OS No. 26 07 964; and the corresponding U.S. Pat. Nos. 3,930,811; 3,937,620; 4,014,664; 4,088,455.

The gasification reactor is generally supplied with granular coal having particle sizes from about 3 to 70 mm; a certain proportion of fine-grained coal is permissible. In addition to coal, brown coal or lignite and peat can be gasified in a fixed bed.

In the operation of known gasification reactors, it was customary to control mainly the supply of the gasifying agents and this control was preferably performed manually by operators. The control was preferably performed in dependence on the exit temperature of the product gas.

When channeling occasionally occurred during the gasification, i.e. when the gasifying agents were flowing upwardly in the fixed bed through channels formed at random in the fixed bed so that the gasifying agents had only a little effect, the exit temperatures of the product gas increased.

That disturbance was counteracted by a change of the speed of the rotating grate.

It has since been found that the grate speed is of great significance for the operation of the gasification reactor and must be very sensitively adjusted. If the speed of the grate is repeatedly changed in a short time, the gasification operation may become unbalanced and particularly the height of the ash layer over the rotating grate may vary greatly. If the ash bed is too low and, as a result, the ash temperature is too high, the material of the rotating grate will be endangered and cracks may form in the parts of the grate.

OBJECTS OF THE INVENTION

It is the principal object of the invention to provide an improved method of operating a gasification reactor of the type described to obviate the drawbacks of earlier methods.

It is another object of the invention to ensure a uniform gasification operation and to provide for a careful, optimum control of the speed of the rotating grate.

SUMMARY OF THE INVENTION

This is accomplished in accordance with the invention in that the temperature in the lock chamber container is measured and, in response to a deviation of said temperature from a desired value, the speed of the rotating grate is changed in such a manner that the speed is lowered in case of an excessively high temperature and increased in case of an insufficiently high temperature.

Surprisingly it has been found that the temperature of the ash, i.e. the temperature in the lock chamber container, represents a parameter accurately reflecting the operating conditions in the gasification reactor and which can be used as a control to obviate the disadvantages enumerated above. In dependence on that temperature the speed is controlled manually by an operator or is automatically controlled.

The temperature which constitutes the controlled variable for the control is suitably measured in the lock chamber container above the highest ash level so that the temperature sensor will not be directly contacted by ash particles.

In accordance with a preferred further feature of the invention the speed is automatically controlled with the aid of a computer. The desired temperature determined as a result of experience can be stored in said computer as a temperature range which varies with time. If such computer is not employed, we furnish the operator with a table indicating the desired temperatures.

Parameters other than the temperature in the ash lock chamber might well be thought to be useful for the control of the grate speed, e.g. the exit temperature of the product gas, the temperature and rate of the gasifying agents and, e.g. the carbon content of the ash. We have found, however, that even in case of a changing fuel supply rate to the reactor the grate speed can be more satisfactorily controlled in dependence on the temperature of the ash lock chamber and on the rate at which oxygen is supplied to the reactor.

BRIEF DESCRIPTION OF THE DRAWING

The above and other objects, features and advantages of the invention will become more readily apparent from the following description reference being made to the accompanying drawing in which.

SPECIFIC DESCRIPTION

Figure 1:
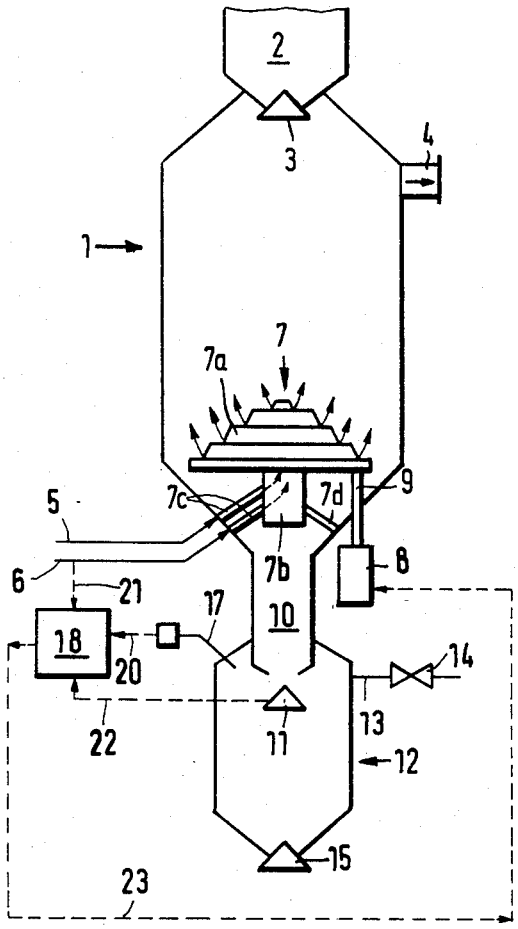
FIG. 1 is a diagrammatic view showing the gasification equipment and the means for controlling the rotating grate.

The gasification reactor 1 per se is of known type and is used for a gasification of granular coal under a superatmospheric pressure of, e.g. 10 to 150 bars. The coal, which constitutes a fixed bed in the reactor, is delivered via a feeding lock chamber 2 having a movable valve 3. Product gas is withdrawn through line 4.

The reactor is fed with gasifying agents consisting of steam, which is supplied in line 5, and oxygen or air, which is supplied in line 6. The gasifying agents are first delivered to the interior of the rotating grate 7 and are distributed into the fixed bed through openings formed in the grate. The rotating grate consists of a rotatable part *7a* and a stationary supporting part *7b*. The part *7a* is driven about a vertical axis by means of a motor 8 and a shaft 9, which cooperates with the rotatable grate part *7a* by means of a pinion, not shown. The grate part *7b* is carried by supporting elements *7c* and *7d*, past which the ash slips down.

The gasifying agents rising in the fixed bed in the reactor 1 heat the fixed bed to high temperatures, which decrease in an upward direction. An ash layer is formed directly over the rotating grate. The ash drops through the ash duct 10 and through the opened valve 11 into the ash lock container 12. When the lock chamber is filled with ash, the valve 11 is closed and the ash chamber 12 is pressure-relieved via line 13, which contains a valve 14. The ash can then flow off through the lower lock chamber valve 15, which has been opened.

The valve 15 is subsequently closed and the empty lock chamber is now pressurized to the pressure in the reactor 1 by a supply of inert gas, such as steam, through line 13. The valve 11 can now be opened so that ash that has collected in duct 10 can flow into the lock chamber 12.

The ash dropping into the lock chamber container 12 has a temperature in the range from about 300° to 350° C. The temperature sensor 17 measures the temperature in the upper portion of the lock chamber 12, in which the temperature changes in accordance with the saw-tooth curve A shown by way of example in FIG. 2. The highest temperature will be obtained when the valve 11 is closed at the time indicated by the dash-dot line B. During the subsequent pressure relief in and discharge from the lock chamber 12, the temperature drops rather steeply and it will begin to rise at the time indicated by the dash-dot line C when the empty lock chamber container 12 has been repressurized and the valve 11 is reopened so that ash can again flow into the container. During the succeeding time between lines C and B, the container 12 is being filled with ash and the temperature rises continuously.

Figure 2:
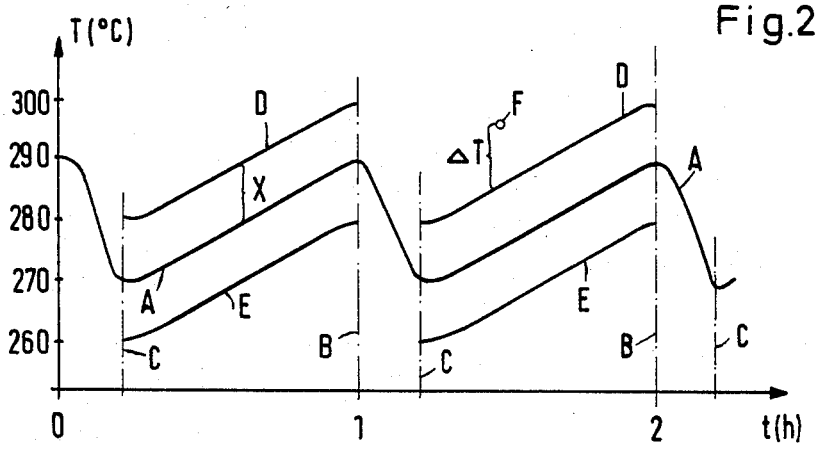
FIG. 2 is a graph plotting temperature along the ordinate versus time along the abscissa which represents an illustrative temperature change pattern in the ash lock chamber.

It has been found that for a control of the speed of the rotating grate 7 in dependence on the temperature changes represented by curve A in FIG. 2 it is suitable to suspend the control for the time interval in which the lock chamber container 12 is pressure-relieved, emptied and repressurized. In FIG. 2 the control is suspended during the period of time between lines B and C. The temperature changes during the other periods will be more uniform and less erratic and for this reason can be used more conveniently for the control of the grate.

Because the control in accordance with the invention will result in a much more uniform gasification operation, it will not be significant that the control is periodically suspended for a relatively short time. As is apparent from FIG. 2, the ash lock chamber 12 is emptied approximately once an hour, and the emptying operation usually takes 5 to 10 minutes, as is indicated by the distance between marks B and C. This is the time in which the speed of the rotating grate is not changed. In case of a higher ash rate, it may be necessary to empty the ash lock chamber in shorter intervals of time.

FIG. 2 shows also the boundary lines D and E, which are parallel to the temperature curve A between marks C and B and extend at the same temperature difference X above and below A, respectively. Those temperatures measured by the sensor 17 which lie on or between the boundary lines D and E will not result in a change of the grate speed. Only a measured temperature outside the temperature range defined by lines D and E, e.g. the temperature represented by the point F, represents an excessive temperature deviation $\Delta T$, which in the present example will result in a decrease of the grate speed so that the subsequently measured temperatures will soon lie again within the permissible temperature range defined by lines D and E.

The speed of the rotating grate 7 is controlled by a computer 18 (FIG. 1) as follows: The computer is regularly supplied with measured value signals from the temperature sensor 17 as represented by the dotted line 20 and from the oxygen supply line 6 as represented by line 21. Signals representing the oxygen feed rate of the gasifying agent are delivered to the computer via line 21. The dotted line 22 indicates that the computer is furnished with lock-chamber status information as to whether the lock chamber 12 is being filled during the time between lines C and B in FIG. 2 or the lock chamber is closed and being pressure-relieved, emptied or repressurized in the time between lines B and C in FIG. 2. Information representing the time-dependent temperature boundary lines D and E has previously been stored in the computer 18. The optimum speed of the grate is determined by the computer, which delivers a corresponding signal via signal line 23 to the drive motor 8.

It has been found that the speed $n_2$ in revolutions per hour can be computed in practice in accordance with the following formula:

$$n_2 = n_1\left(1 + \frac{\Delta S}{S}\right) + \frac{\Delta T}{C}$$

wherein $n_1$ = the last speed (in r.p.h.) of the rotating grate which has been adjusted before the change;

S = the oxygen rate in $m^3/h$ in the gasifying agent that has previously been taken into account;

$\Delta S$ = the difference between the actual oxygen rate and the rate that has previously been taken into account;

$\Delta T$ = the temperature difference in °C. between the desired and actual temperatures (see FIG. 2) in case of an excessively high temperature, $\Delta T$ will be negative and will result in a speed decrease; and C = an empirical correcting value, generally a constant for a given apparatus and coal, (in °C/r.p.h.), which is in the range from about 5° to 30° C./r.p.h.

It is usually sufficient to process measured values in the computer at intervals of about 2 to 10 minutes so that the computer will determine whether a new speed $n_2$ of the grate is required. Because a temperature deviation $\pm X$ from the ideal temperature curve is tolerated and will not result in a speed change, a frequent change of the grate speed by small increments will be avoided. In practice, the permissible temperature variation X will be about 5° to 15° C. and is 10° C. in the example illustrated in FIG. 2.

EXAMPLES

Two examples based on the following data have been calculated with the aid of the above-mentioned formula:

| | Example 1 | Example 2 |
|---|---|---|
| $n_1$ (r.p.h.) | 3.5 | 3.5 |

-continued

| | Example 1 | Example 2 |
|---|---|---|
| ΔT (°C.) | +2 | −5 |
| C (°C./r.p.h.) | 10 | 10 |
| ΔS ($m^3$/h) | 6 | 0 |
| S ($m^3$/h) | 60 | 60 |
| The computed speed $n_2$(r.p.h.) is | 4.05 | 3.0 |

We claim:

1. A method of operating a reactor for gasifying a solid fuel at a pressure in the range of 10 to 150 bar, said reactor comprising a rotating grate, a lock chamber container below said grate and means for feeding oxygen and at least one gasifying agent selected from the group which consists of steam and carbon dioxide through said grate into the reactor, which method comprises the steps of:

(a) treating a bed of solid fuel above said grate with at least one gasifying agent to gasify said solid fuel and leave incombustible mineral matter in said bed;

(b) rotating said grate at a controlled speed to discharge said incombustible mineral matter as ash into said lock chamber container;

(c) periodically closing, pressure-relieving and emptying said lock chamber container and producing a corresponding first signal;

(d) measuring the temperature in the lock chamber container above the highest ash level in said lock chamber container and producing a corresponding second signal representing said temperature above the highest ash level in said lock chamber;

(e) in response to a deviation of said temperature as measured and a corresponding change in value of said second signal from a desired temperature range, varying the speed of the rotating grate in such a manner that the speed is lowered in case of an excessively high temperature and increased in case of an insufficiently high temperature, said temperature range varying with time;

(f) also monitoring an oxygen-feed rate of oxygen fed to said bed and producing a corresponding third signal, controlling the speed of the rotating grate with said third signal to increase the same in case of a higher oxygen supply rate;

(g) interrupting changes in the speed of the rotating grate for time intervals during which the lock chamber container is being emptied; and (h) automatically controlling and varying said speed with a computer preprogrammed with said temperature range, said computer being supplied with said first, second and third signal.

* * * * *